US009003980B1

(12) United States Patent
Chang

(10) Patent No.: US 9,003,980 B1
(45) Date of Patent: Apr. 14, 2015

(54) FOLDABLE TABLE WITH STACKING ARRANGEMENT

(71) Applicant: Mei-Fang Chang, Shenzhen (CN)

(72) Inventor: Mei-Fang Chang, Shenzhen (CN)

( * ) Notice: Subject to any disclaimer, the term of this patent is extended or adjusted under 35 U.S.C. 154(b) by 0 days.

(21) Appl. No.: 14/155,326

(22) Filed: Jan. 14, 2014

(51) Int. Cl.
*A47B 7/02* (2006.01)
*A47B 3/087* (2006.01)

(52) U.S. Cl.
CPC ..... *A47B 3/087* (2013.01)

(58) Field of Classification Search
CPC ..... A47B 3/0912; A47B 13/08; A47B 3/087; A47B 13/003; A47B 7/02; A47B 87/02; A47B 87/0246; B29L 2031/448
USPC ..... 108/91, 129–132, 125, 126, 901, 53.1, 108/53.3
See application file for complete search history.

(56) References Cited

U.S. PATENT DOCUMENTS

| | | | | |
|---|---|---|---|---|
| 2,540,849 | A * | 2/1951 | Walker | 108/91 |
| 7,707,947 | B2 * | 5/2010 | Winter et al. | 108/27 |
| 8,683,929 | B2 * | 4/2014 | Peery et al. | 108/132 |
| 8,757,069 | B2 * | 6/2014 | Peery et al. | 108/132 |
| 2003/0221595 | A1 * | 12/2003 | Reinsch et al. | 108/91 |
| 2004/0031422 | A1 * | 2/2004 | Wong | 108/132 |
| 2005/0098068 | A1 * | 5/2005 | Tsai | 108/91 |
| 2006/0130716 | A1 * | 6/2006 | Ashby et al. | 108/125 |

* cited by examiner

*Primary Examiner* — Janet M Wilkens
(74) *Attorney, Agent, or Firm* — Raymond Y. Chan; David and Raymond Patent Firm

(57) ABSTRACT

A foldable table includes a tabletop having a top side and a bottom side, a leg frame, and a stacking arrangement which includes a stackable rim integrally and downwardly extended from the top side of the tabletop to a position that a bottom edge of the stackable rim is downwardly extended below the bottom side of the tabletop, wherein a stacking area is defined within the bottom edge of the stackable rim that the stacking area is larger than a top area of the top side of the tabletop. Therefore, when two or more foldable tables are stacked together, the top side of the foldable table is received within the stacking area of another foldable table to substantially retain the two foldable tabletops in position and avoid a lateral relative movement between the foldable tables.

21 Claims, 5 Drawing Sheets

FOLDABLE TABLE WITH STACKING ARRANGEMENT

NOTICE OF COPYRIGHT

A portion of the disclosure of this patent document contains material which is subject to copyright protection. The copyright owner has no objection to any reproduction by anyone of the patent disclosure, as it appears in the United States Patent and Trademark Office patent files or records, but otherwise reserves all copyright rights whatsoever.

BACKGROUND OF THE PRESENT INVENTION

1. Field of Invention

The present invention relates to a foldable table, and more particularly to a foldable table with a stacking arrangement, wherein two or more foldable tables can be overlappedly stacked and interlocked with each other so as to ensure the stabilization of the stacked foldable tables.

2. Description of Related Arts

Foldable tables, such as banquet tables, have become very popular since the tables are economy, cheap and foldable that can be quickly and easily folded for carriage and storage and unfolded for use. Especially when some participant-intensive activities take place in multi-function rooms or designated areas, the foldable tables can be temporary set up in minutes. After the functions, the foldable tables can be quickly and neatly folded up for storage. However, the foldable tables cannot be stacked with each other.

Generally speaking, the tabletop of the foldable table has a flat top side and a bottom side that the size of the top side is the same as the size of the bottom side. In other words, when the foldable tables are stacked each other, the bottom side of the upper foldable table is overlapped with the top side of the lower foldable table. There is no engagement between the stacked foldable tables. Therefore, especially when two or more foldable tables are stacked together, the foldable tables cannot be stably held with each other. When an external force is exerted at the stacked foldable tables, the foldable tables will be collapsed. It is dangerous when the stacked foldable tables are transported or even stored.

An improved foldable table is designed to be stackable. Accordingly, the foldable table has an indention formed at the peripheral rim of the top side of the tabletop and a protrusion formed the peripheral rim of the bottom side of the tabletop. Therefore, when stacking the foldable table, the protrusion of the upper foldable table is engaged with the indention of the lower foldable table, so as to prevent any unwanted sliding movement between the foldable tables. However, such foldable table has several drawbacks.

Since the indention must be formed at the top side of the foldable table, a utilizing area of the top side of the foldable table will be reduced. Since the user is used to place the plate or dish close to the peripheral rim of foldable table due to the eating habit, the indention will compel the user to place the plate or dish away from the indention, i.e. toward the center of the foldable table. Dirt and dust will also be accumulated at the indention of the top side of the foldable table.

Since the protrusion of the upper foldable table is engaged with the indention of the lower foldable table to stack up the foldable tables, the surrounding walls of the stacked foldable tables are aligned at the same planar direction. Therefore, the upper foldable table is hard to take away from the lower foldable table. In other words, the secure engagement between the indention and the protrusion of the foldable tables will prohibit the upper foldable table to be removed from the stacked foldable table.

The manufacturing process is complicated that the size and shape of the protrusion must be exact the same of the size and shape of the indention. If the protrusion does not match with the indention, the foldable tables cannot be stacked securely.

SUMMARY OF THE PRESENT INVENTION

The invention is advantageous in that it provides a foldable table with a stacking arrangement, wherein two or more foldable tables can be overlappedly stacked and interlocked with each other so as to ensure the stabilization of the stacked foldable tables.

Another advantage of the invention is to provide a foldable table with a stacking arrangement, wherein the upper foldable table can be easily removed from the stacked foldable tables so as to enhance the practical use of the foldable table.

Another advantage of the invention is to provide a foldable table with a stacking arrangement, wherein no indentation is formed on the top side of the tabletop of the foldable table, so as to maximize the utilizing area of the top side of the foldable table.

Another advantage of the invention is to provide a foldable table with a stacking arrangement, wherein the stacking arrangement is simple and easy to manufacture with the tabletop, which can simplify the manufacturing process of the tabletop so as to substantially reduce the manufacturing cost of the foldable table.

Another advantage of the invention is to provide a foldable table with a stacking arrangement, which does not require to alter the original structural design of the foldable table, so as to minimize the manufacturing cost of the stacking arrangement incorporating with the tabletop.

Another advantage of the invention is to provide a foldable table with a stacking arrangement, wherein no expensive or complicated structure is required to employ in the present invention in order to achieve the above mentioned objects. Therefore, the present invention successfully provides an economic and efficient solution for providing a stable configuration for the foldable table to support and stack up the foldable tables in a stably manner.

Additional advantages and features of the invention will become apparent from the description which follows, and may be realized by means of the instrumentalities and combinations particular point out in the appended claims.

According to the present invention, the foregoing and other objects and advantages are attained by a foldable table, which comprises:

a tabletop having a top side and a bottom side;

a leg frame foldably coupled at the bottom side of the tabletop; and a stacking arrangement which comprises a stackable rim integrally and downwardly extended from the top side of the tabletop to a position that a bottom edge of the stackable rim is downwardly extended below the bottom side of the tabletop, wherein a stacking area is defined within the bottom edge of the stackable rim that the stacking area is larger than a top area of the top side of the tabletop.

Therefore, when two or more foldable tables are stacked with each other, the top side of the foldable table is received within the stacking area of another foldable table to substantially retain the two foldable tabletops in position and avoid a lateral relative movement between the foldable tables.

In accordance with another aspect of the invention, the present invention comprises a tabletop frame for a foldable table which comprises a leg frame, comprising:

a tabletop having a top side, a bottom side, and a leg frame cavity formed at the bottom side of the tabletop for receiving the leg frame when the leg frame is folded at the bottom side; and a stacking arrangement which comprises a stackable rim integrally and downwardly extended from a top side of the tabletop to a position that a bottom edge of the stackable rim is downwardly extended below the leg frame cavity of the tabletop, wherein a stacking area is defined within the bottom edge of the stackable rim that the stacking area is larger than a top area of the top side of the tabletop.

Still further objects and advantages will become apparent from a consideration of the ensuing description and drawings.

These and other objectives, features, and advantages of the present invention will become apparent from the following detailed description, the accompanying drawings, and the appended claims.

DETAILED DESCRIPTION OF THE PREFERRED EMBODIMENT

The following description is disclosed to enable any person skilled in the art to make and use the present invention. Preferred embodiments are provided in the following description only as examples and modifications will be apparent to those skilled in the art. The general principles defined in the following description would be applied to other embodiments, alternatives, modifications, equivalents, and applications without departing from the spirit and scope of the present invention.

Figure 1:
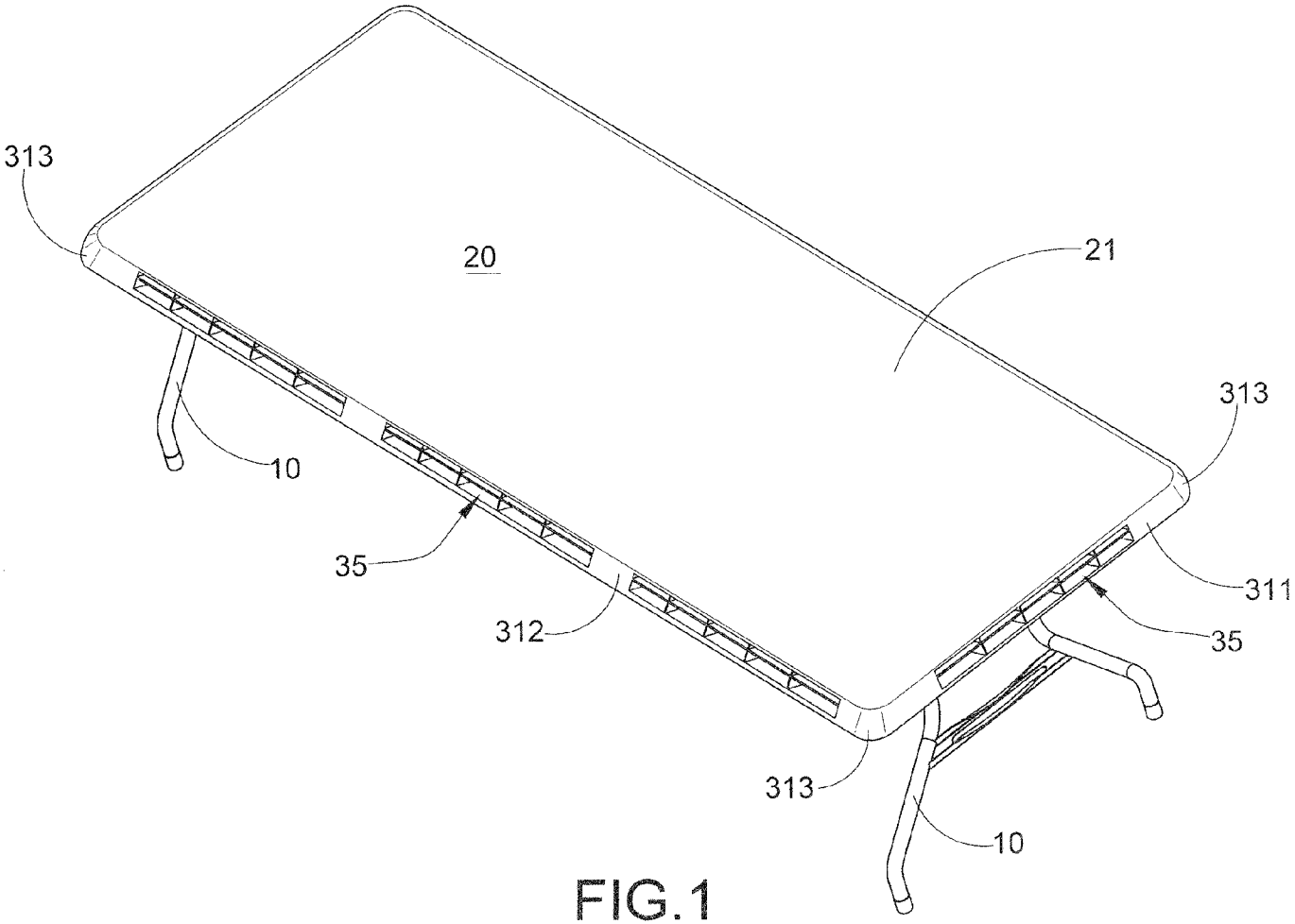
FIG. 1 is a perspective view of a foldable table with a stacking arrangement according to a preferred embodiment of the present invention.
Figure 2:
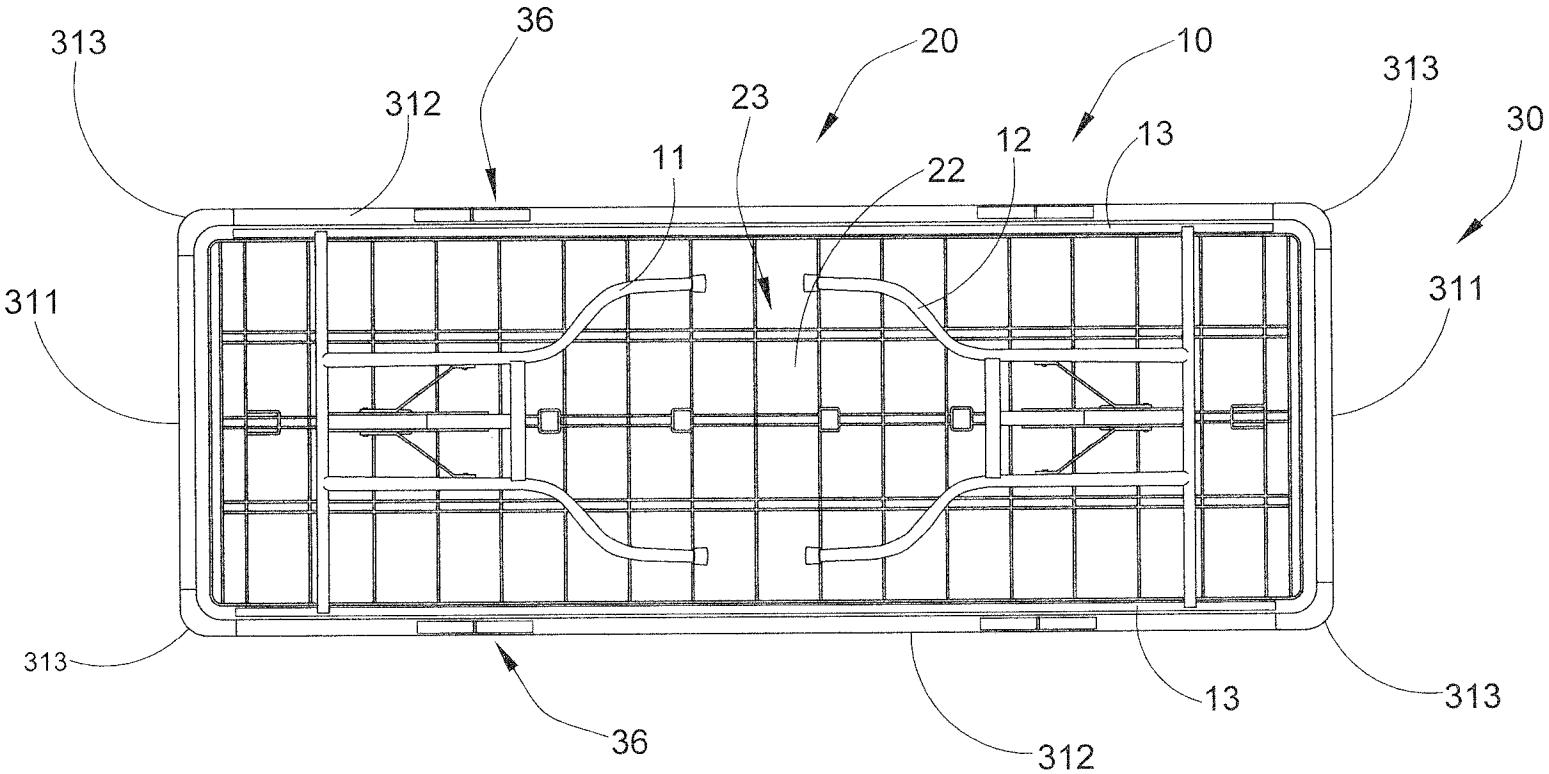
FIG. 2 is a bottom view of the foldable table according to the above preferred embodiment of the present invention.

Referring to FIGS. 1 and 2 of the drawings, a foldable table according to a preferred embodiment of the present invention is illustrated. Accordingly, the foldable table comprises a leg frame 10 and a tabletop frame which comprises a stacking arrangement 30 and a tabletop 20 having a top side 21 and a bottom side 22.

The leg frame 10 is foldably coupled at a bottom side 22 of the tabletop 20, wherein the leg frame 10 comprises first and second legs 11, 12 spacedly coupled at the bottom side of the tabletop 20. Preferably, the leg frame 10 further comprises two runners 13 extended along two longitudinal sides of the tabletop 20 at the bottom side 22 thereof, wherein the first and second legs 11, 12 are pivotally coupled between the two runners 13 to fold between an unfolded position that the first and second legs 11, 12 are pivotally and outwardly moved away from the bottom side 22 of the tabletop 20, and a folded position that the first and second legs 11, 12 are pivotally and inwardly moved on the bottom side of the tabletop 20.

The tabletop 20 is preferably an injection mold tabletop that defines the top side 21 with a utilizing area and the bottom side 22 forming a leg frame cavity 23 thereat for receiving the leg frame 10 within the leg frame cavity 23 when the leg frame 10 is folded at the folded position.

The stacking arrangement 30 is integrated with the tabletop 20 in order to enable two or more foldable tables of the present invention to be stacked with each other. The stacking arrangement 30 comprises a stackable rim 31 integrally and downwardly extended from the top side 21 of the tabletop 20 to a position that a bottom edge 301 of the stackable rim 31 is downwardly extended below the bottom side 22 of the tabletop 20. In particular, the bottom edge 301 of the stackable rim 31 is downwardly extended below the leg frame cavity 23 of the tabletop 20.

Accordingly, a stacking area is defined within the bottom edge 301 of the stackable rim 31 that the stacking area is larger than a top area of the top side 21 of the tabletop 20. In particular, the top side 21 of the tabletop 20 is integrally extended from an outer side of the stackable rim 31 in an indention-less manner, such that no indention is formed at the top side 21 of the tabletop 20 or at a connection area between the periphery of the tabletop 20 and the stackable rim 31, so as to maximize the edge-to-edge utilizing area of the top side 21 of the table top 20 of the foldable table.

Figure 3:
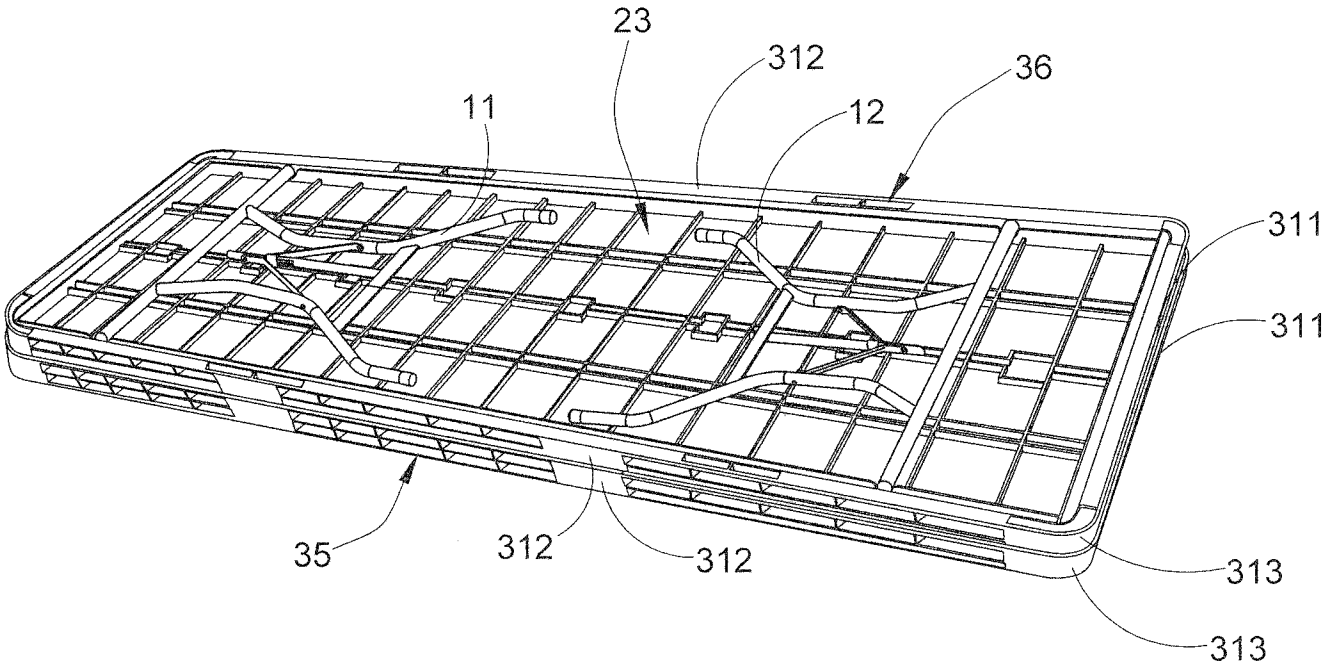
FIG. 3 is a perspective view of the stacked foldable tables according to the above preferred embodiment of the present invention.
Figure 4:
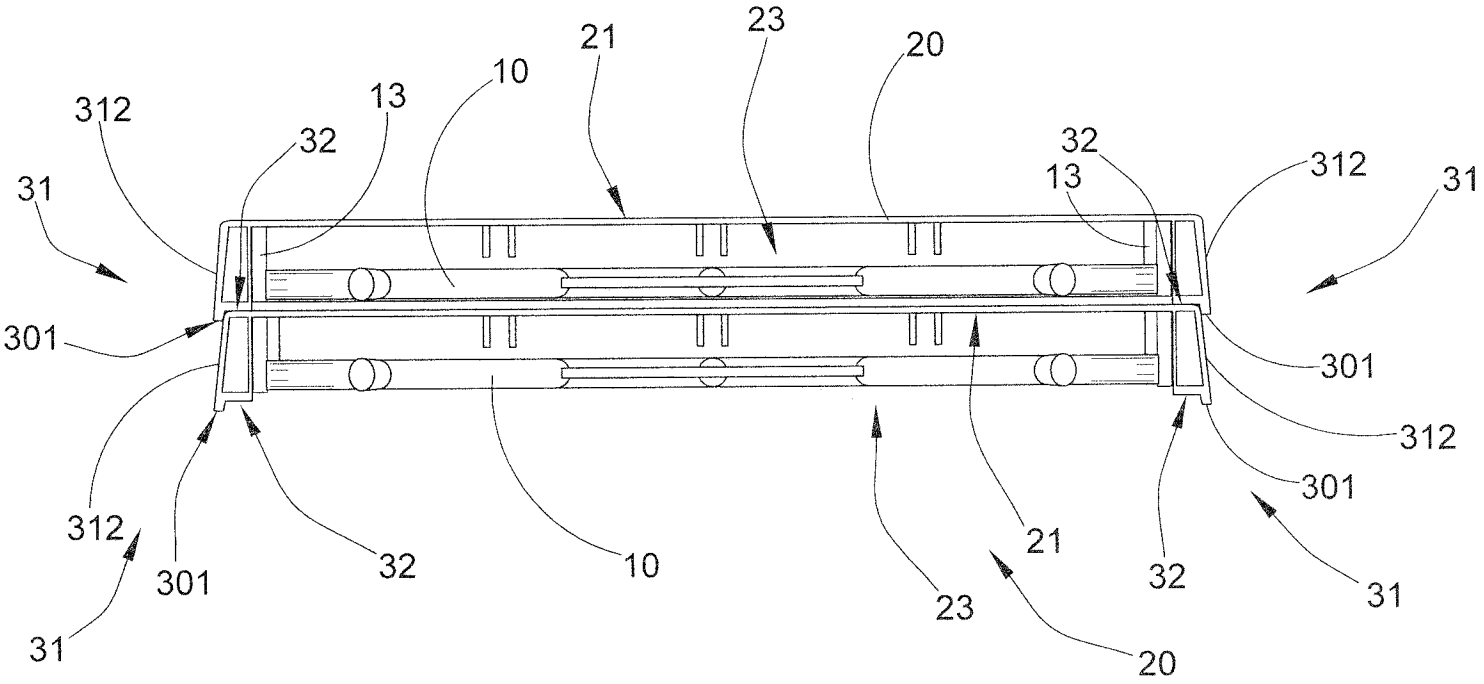
FIG. 4 is a sectional view of the stacked foldable tables according to the above preferred embodiment of the present invention.

Through the stacking arrangement 30, two or more foldable tables are adapted to stack together by receiving the top side 21 of the foldable table within the stacking area of another foldable table to substantially retain the two foldable tabletops in position and avoid a lateral relative movement between the foldable tables, as shown in FIGS. 3 and 4. In other words, when two foldable tables are stacked together, the top side 21 of the tabletop 20 of the lower foldable table is received within the bottom edge 301 of the stackable rim 31 of the upper foldable table.

As shown in FIGS. 2 to 4, the stackable rim 31 comprises two transverse edge rim portions 311 downwardly and outwardly extended at two transverse sides of the tabletop 20 respectively, and two longitudinal edge rim portions 312 downwardly and outwardly extended at two transverse sides of the tabletop 20 respectively.

Therefore, when the foldable tables are stacked with each other, the two transverse sides of the tabletop 20 of the foldable table at the top side 21 thereof are received at the transverse edge rim portions 311 of the stackable rim 31 of another foldable table respectively. Likewise, the two longitudinal sides of the tabletop 20 of the foldable table at the top side 21 thereof are received at the longitudinal edge rim portions 312 of the stackable rim 31 of another foldable table respectively.

The stackable rim 31 further comprises four cornering rim portions 313 downwardly and outwardly extended from four corresponding corners of the tabletop 20 respectively. When the foldable tables are stacked with each other, the four corners of the tabletop 20 of the foldable table at the top side 21 thereof are received at the cornering rim portions 313 of the stackable rim 31 of another foldable table respectively.

Each of the cornering rim portions 313 is integrally extended between one of the transverse edge rim portions 311 of the stackable rim 31 and the corresponding longitudinal edge rim portion 312 thereof. Therefore, each of the transverse edge rim portions 311 of the stackable rim 31 is integrally extended between two of the cornering rim portions 313 thereof. Likewise, each of the longitudinal edge rim portions 312 of the stackable rim 31 is integrally extended between two of the cornering rim portions 313 thereof. In other words, the transverse edge rim portions 311, the longitudinal edge rim portions 312, and the cornering rim portions 313 are integrated to integrally form a peripherally surrounding rim at the periphery of the tabletop 20.

In other words, when two foldable tables are stacked together, the two transverse sides, the two longitudinal sides, and the four corners of the tabletop 20 of the lower foldable table are received within the bottom edges 301 of the transverse edge rim portions 311, the longitudinal edge rim portions 312, and the cornering rim portions 313 of the stackable rim 31 of the upper foldable table respectively.

As shown in FIG. 4, the stackable rim 31 is inclinedly and outwardly extended from the top side 21 of the tabletop 20. In other words, the transverse edge rim portions 311, the longitudinal edge rim portions 312, and the cornering rim portions 313 are inclinedly and outwardly extended from the periphery of the tabletop 20.

Figure 5:
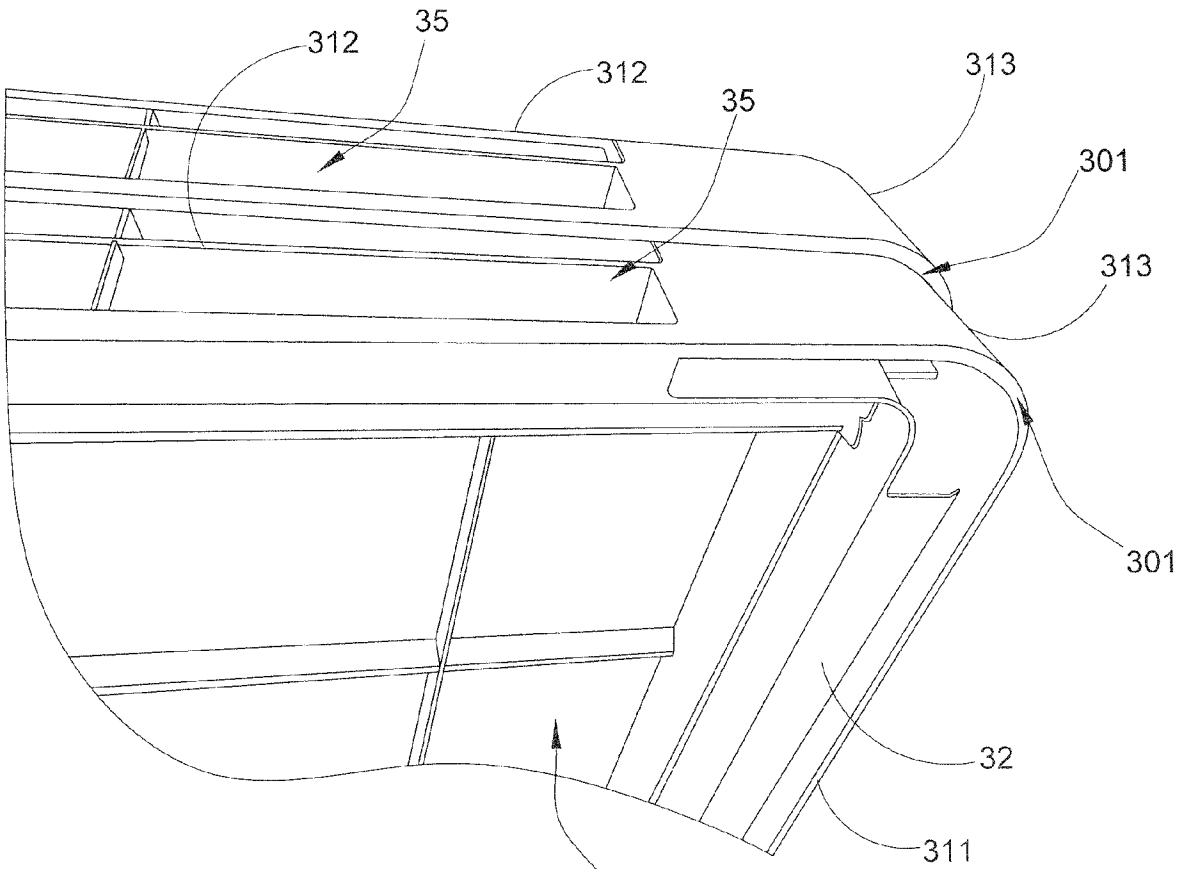
FIG. 5 is a partially perspective view of the stacking arrangement of the stacked foldable tables according to the above preferred embodiment of the present invention.

As shown in FIGS. 4 and 5, the stacking arrangement 30 further comprises a resting platform 32 integrally and inwardly extended from an inner side of the stackable rim 31 at a position between the bottom edge 301 of the stackable rim 31 and the bottom side 22 of the tabletop 20, such that when the foldable tables are stacked with each other, the resting platform 32 of the foldable table is rested on the top side 21 of the tabletop 20 of another foldable table. In other words, the resting platform 32 of the upper foldable table is rested on the top side 21 of the tabletop 20 of the lower foldable table when two foldable tables are stacked together. It is worth mentioning that only the tabletops 20 are shown in FIG. 5 while the leg frame 10 is omitted in FIG. 5 to show the detail structure of the stacking arrangement 30.

Accordingly, the resting platform 32 is positioned slightly below the leg frame cavity 23 of the tabletop 20. Therefore, when the leg frame 10 is folded into the leg frame cavity 23, the resting platform 32 is positioned below the folded leg frame 10. When the foldable tables are stacked together, the resting platform 32 of the upper foldable table is rested on the top side 21 of the tabletop 20 of the lower foldable table, so as to prevent the top side 21 of the tabletop 20 of the lower foldable table from being contacted with the folded leg frame 10 of the upper foldable table. Accordingly, the resting platform 32 will prevent the top side 21 of the tabletop 20 of the lower foldable being scratched by the folded leg frame 10 of the upper foldable table.

The stacking arrangement 30 further comprises a plurality of handle units 35 spacedly provided at the outer side of the stackable rim 31 for enabling the foldable table to be easily detached from the stacked foldable tables. Accordingly, the handles units 35 are an elongated slots indented on the outer side of the stackable rim 31 at a position close to the bottom edge 301 thereof, wherein when the foldable tables are stacked together, the bottom edge 301 of the upper foldable table will not cover the handle units 35 of the lower foldable table. In other words, the handle units 35 are located below the top side 21 of the tabletop 20 at a predetermined distance. Therefore, the distance between the resting platform 32 and the bottom edge 301 of the stackable rim 31 is smaller than the distance between the top side 21 of the tabletop 20 and the handle unit 35.

Preferably, the handles units 35 are spacedly found at the outer sides of the transverse edge rim portions 311 and the longitudinal edge rim portions 312 of the stackable rim 31. Therefore, when the foldable tables are stacked together, the user is able to insert the fingers into the handle units 35 to lift up the upper foldable table from the lower foldable table.

The stacking arrangement 30 further comprises a plurality of carrying units 36 spacedly provided at the bottom side of the stackable rim 31 for enabling the foldable table to be easily carried. Accordingly, the carrying units 36 are an elongated slots indented on the bottom side of the stackable rim 31. In particular, the carrying units 36 are formed at the resting platform 32 and are spacedly formed at the longitudinal edge rim portions 312 of the stackable rim 31. Therefore, the carrying units 36 form the carrying grips for the user to carry the stacked foldable tables.

As it is mentioned above, the tabletop 20 is made by injection mold process such that during the process, the stacking arrangement 30 is integrally formed with the tabletop 20 to form the tabletop frame. Accordingly, the tabletop frame can be incorporated with different types of leg frame 10 having a foldable feature. During the manufacturing process of the foldable table, the tabletop frames can be formed and stacked with each other in order to save the storage space in the warehouse. Then, after the leg frame 10 is installed into each of the tabletop frames to form the foldable table, the foldable tables can be stacked with each other to save the storage and packaging space. Once the foldable tables are stacked with each other, the stacked foldable tables will be interlocked with each other via the top side 21 of the tabletop 20 and the stacking arrangement 30 so as to ensure the stabilization of the stacked foldable tables.

One skilled in the art will understand that the embodiment of the present invention as shown in the drawings and described above is exemplary only and not intended to be limiting.

It will thus be seen that the objects of the present invention have been fully and effectively accomplished. The embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A foldable table, comprising:

a tabletop having a top side and a bottom side;

a leg frame foldably coupled at said bottom side of said tabletop; and a stacking arrangement which comprises a stackable rim integrally and downwardly extended from said top side of said tabletop to a position that a bottom edge of said stackable rim is downwardly extended below said bottom side of said tabletop, wherein a stacking area is defined within said bottom edge of said stackable rim that said stacking area is larger than a top area of said top side of said tabletop, wherein said top side of said tabletop is integrally extended from an outer side of said stackable rim in an indention-less manner, wherein said stackable rim is inclinedly and outwardly extended from said top side of said tabletop;

thereby, said foldable table is adapted to stack on another said foldable table by receiving said top side of said foldable table within said stacking area of another said foldable table to substantially retain said two foldable tabletops in position and avoid a lateral relative movement between said foldable tables.

2. The foldable table, as recited in claim 1, wherein said stackable rim comprises two transverse edge rim portions downwardly and outwardly extended at two transverse sides of said tabletop respectively, such that when said foldable tables are stacked with each other, said two transverse sides of said foldable table at said top side thereof are received at said transverse edge rim portions of said stackable rim of another said foldable table respectively.

3. The foldable table, as recited in claim 2, wherein said stackable rim comprises four cornering rim portions downwardly and outwardly extended from four corresponding corners of said tabletop respectively, such that when said foldable tables are stacked with each other, said four corners of said foldable table at said top side thereof are received at said cornering rim portions of said stackable rim of another said foldable table respectively.

4. The foldable table, as recited in claim 3 wherein each of said transverse edge rim portions of said stackable rim is integrally extended between two of said cornering rim portions thereof.

5. The foldable table, as recited in claim 3, wherein said stackable rim comprises two longitudinal edge rim portions downwardly and outwardly extended at two longitudinal sides of said tabletop respectively, such that when said foldable tables are stacked with each other, said two longitudinal sides of said foldable table at said top side thereof are received at said longitudinal edge rim portions of said stackable rim of another said foldable table respectively.

6. The foldable table, as recited in claim 5, wherein each of said longitudinal edge rim portions of said stackable rim is integrally extended between two of said cornering rim portions thereof.

7. The foldable table, as recited in claim 6, wherein said stacking arrangement further comprises a resting platform integrally and inwardly extended from an inner side of said stackable rim at a position between said bottom edge of said stackable rim and said bottom side of said tabletop, such that when said foldable tables are stacked with each other, said resting platform of said foldable table is rested on said top side of another said foldable table.

8. The foldable table, as recited in claim 7, wherein said tabletop further has a leg frame cavity formed at said bottom side of said tabletop to receive said leg frame when said leg frame is folded at said bottom side of said tabletop, wherein said bottom edge of said stackable rim is downwardly extended below said leg frame cavity.

9. The foldable table, as recited in claim 3, wherein said stacking arrangement further comprises a resting platform integrally and inwardly extended from an inner side of said stackable rim at a position between said bottom edge of said stackable rim and said bottom side of said tabletop, such that when said foldable tables are stacked with each other, said resting platform of said foldable table is rested on said top side of another said foldable table.

10. The foldable table, as recited in claim 3, wherein said tabletop further has a leg frame cavity formed at said bottom side of said tabletop to receive said leg frame when said leg frame is folded at said bottom side of said tabletop, wherein said bottom edge of said stackable rim is downwardly extended below said leg frame cavity.

11. A tabletop frame for a foldable table having a leg frame, comprising:

a tabletop having a top side, a bottom side, and a leg frame cavity formed at said bottom side of said tabletop for receiving said leg frame when said leg frame is folded at said bottom side of said tabletop; and a stacking arrangement which comprises a stackable rim integrally, downwardly, and inclinedly extended from said top side of said tabletop to a position that a bottom edge of said stackable rim is downwardly extended below said leg frame cavity of said tabletop, wherein a stacking area is defined within said bottom edge of said stackable rim that said stacking area is larger than a top area of said top side of said tabletop;

thereby, said foldable table is adapted to stack on another said foldable table by receiving said top side of said foldable table within said stacking area of another said foldable table to substantially retain said two foldable tabletops in position and avoid a lateral relative movement between said foldable tables.

12. The tabletop frame, as recited in claim 11, wherein said stackable rim comprises four cornering rim portions downwardly and outwardly extended from four corresponding corners of said tabletop respectively, such that when said foldable tables are stacked with each other, said four corners of said foldable table at said top side thereof are received at said cornering rim portions of said stackable rim of another said foldable table respectively.

13. The tabletop frame, as recited in claim 11, wherein said stackable rim comprises two transverse edge rim portions downwardly and outwardly extended at two transverse sides of said tabletop respectively, and two longitudinal edge rim portions downwardly and outwardly extended at two longitudinal sides of said tabletop respectively, such that when said foldable tables are stacked with each other, said transverse and longitudinal sides of said foldable table at said top side thereof are received at said transverse and longitudinal edge rim portions of said stackable rim of another said foldable table respectively.

14. The tabletop frame, as recited in claim 12, wherein said stackable rim comprises two transverse edge rim portions downwardly and outwardly extended at two transverse sides of said tabletop respectively, and two longitudinal edge rim portions downwardly and outwardly extended at two longitudinal sides of said tabletop respectively, such that when said foldable tables are stacked with each other, said transverse and longitudinal sides of said foldable table at said top side thereof are received at said transverse and longitudinal edge rim portions of said stackable rim of another said foldable table respectively.

15. The tabletop frame, as recited in claim 14, wherein each of said transverse edge rim portions of said stackable rim is integrally extended between two of said cornering rim portions thereof, wherein each of said longitudinal edge rim portions of said stackable rim is integrally extended between two of said cornering rim portions thereof.

16. The tabletop frame, as recited in claim 15, wherein said stacking arrangement further comprises a resting platform integrally and inwardly extended from an inner side of said stackable rim at a bottom of said leg frame cavity, such that when said foldable tables are stacked with each other, said resting platform of said foldable table is rested on said top side of another said foldable table.

17. The tabletop frame, as recited in claim 11, wherein said stacking arrangement further comprises a resting platform integrally and inwardly extended from an inner side of said stackable rim at a bottom of said leg frame cavity, such that when said foldable tables are stacked with each other, said resting platform of said foldable table is rested on said top side of another said foldable table.

18. A foldable table, comprising:

a tabletop having a top side and a bottom side;

a leg frame foldably coupled at said bottom side of said tabletop; and a stacking arrangement which comprises a stackable rim integrally and downwardly extended from said top side of said tabletop to a position that a bottom edge of said stackable rim is downwardly extended below said bottom side of said tabletop, wherein a stacking area is defined within said bottom edge of said stackable rim that said stacking area is larger than a top area of said top side of said tabletop, wherein said top side of said tabletop is integrally extended from an outer side of said stackable rim in an indention-less manner, wherein said stackable rim comprises two transverse edge rim portions downwardly and outwardly extended at two transverse sides of said tabletop respectively, such that when said foldable tables are stacked with each other, said two transverse sides of said foldable table at said top side thereof are received at said transverse edge rim portions of said stackable rim of another said foldable table respectively, wherein said stackable rim comprises four cornering rim portions downwardly and outwardly extended from four corresponding corners of said tabletop respectively, such that when said foldable tables are stacked with each other, said four corners of said foldable table at said top side thereof are received at said cornering rim portions of said stackable rim of another said foldable table respectively;

thereby, said foldable table is adapted to stack on another said foldable table by receiving said top side of said foldable table within said stacking area of another said foldable table to substantially retain said two foldable tabletops in position and avoid a lateral relative movement between said foldable tables.

19. The foldable table, as recited in claim 18, wherein each of said transverse edge rim portions of said stackable rim is integrally extended between two of said cornering rim portions thereof.

20. The foldable table, as recited in claim 18, wherein said stackable rim comprises two longitudinal edge rim portions downwardly and outwardly extended at two longitudinal sides of said tabletop respectively, such that when said foldable tables are stacked with each other, said two longitudinal sides of said foldable table at said top side thereof are received at said longitudinal edge rim portions of said stackable rim of another said foldable table respectively.

21. The foldable table, as recited in claim 20, wherein each of said longitudinal edge rim portions of said stackable rim is integrally extended between two of said cornering rim portions thereof.

* * * * *